United States Patent [19]

Lu

[11] 4,412,895

[45] Nov. 1, 1983

[54] SYSTEM USING $SO_2$ AS AN ANODE DEPOLARIZER IN A SOLID OXIDE ELECTROLYTE ELECTROLYSIS CELL FOR $H_2$ PRODUCTION FROM STEAM

[75] Inventor: Wen-Tong P. Lu, Pittsburgh, Pa.

[73] Assignee: Westinghouse Electric Corp., Pittsburgh, Pa.

[21] Appl. No.: 307,137

[22] Filed: Sep. 29, 1981

[51] Int. Cl.[3] ..... C25B 1/02

[52] U.S. Cl. ..... 204/129

[58] Field of Search ..... 204/129

[56] References Cited

U.S. PATENT DOCUMENTS

| | | | |
|---|---|---|---|
| 3,616,334 | 10/1971 | Aker et al. | 204/129 |
| 3,630,879 | 12/1971 | Spacil et al. | 204/129 |
| 3,888,750 | 6/1975 | Brecher et al. | 204/129 |
| 3,993,653 | 11/1976 | Blum et al. | 204/129 |
| 4,024,036 | 5/1977 | Nakamura et al. | 204/129 |
| 4,059,496 | 11/1977 | Schulten et al. | 204/129 |

*Primary Examiner*—R. L. Andrews

*Attorney, Agent, or Firm*—D. P. Cillo

[57] ABSTRACT

Hydrogen gas is produced from water vapor by: (1) supplying water vapor to the cathode and $SO_2$ to the anode of an electrolysis cell utilizing a solid oxide electrolyte which has a high oxygen ion conduction but which is impervious to $H_2$ and $SO_2$, between the cathode and anode, to provide $H_2$ and a mixture of $SO_2$ and $SO_3$, (2) passing the $SO_3$ into a reduction reactor operating at a temperature effective to decompose it and provide a mixture of $SO_2$ and $O_2$, and (3) passing the $SO_2$ back to the anode of the electrolysis cell.

8 Claims, 2 Drawing Figures

SYSTEM USING $SO_2$ AS AN ANODE DEPOLARIZER IN A SOLID OXIDE ELECTROLYTE ELECTROLYSIS CELL FOR $H_2$ PRODUCTION FROM STEAM

BACKGROUND OF THE INVENTION

Hydrogen is one of the most abundant elements on earth. It is found in water, and in most matter. Because it can be burned as a fuel, it has great potential as an energy carrier. However, hydrogen is rarely found in a free state. It is usually part of a compound.

To be used, hydrogen must be isolated. At this time, most hydrogen is manufactured by the steam reforming of natural gas, or partial oxidation of oil. Water electrolysis is also a well-known technology for producing hydrogen. Due to the high electrical energy needed to decompose water, however, the production cost of electrolytic hydrogen is almost three times higher than that of hydrogen derived from fossil fuels. While the large-scale hydrogen market is mainly in the fertilizer, petrochemical, metallurgical, pharmaceutical and food processing industries, there is a strong possibility of using hydrogen, in large quantities, as a clean fuel in fuel cells and gas turbines. According to some estimates, the highly expanding hydrogen market will result in a demand for hydrogen to a level of at least three times higher than the current hydrogen supply at the end of the century.

With the continued increase in costs and dwindling availability of oil and natural gas, the development of alternative techniques for hydrogen generation, using non-fossil energy sources, is of crucial importance in order to meet the anticipated enhancement in demands for hydrogen. Recently, a number of advanced concepts have been proposed for bulk hydrogen production.

Aker et al., in U.S. Pat. No. 3,616,334, produce $H_2$ from steam, utilizing a stabilized zirconia electrolyte electrolyzer in an open cycle. There, a mixture of $CO/H_2$ gas is used as an anode depolarizer in a solid oxide electrolyte electrolysis cell. Hydrocarbon fuel is burned to provide CO for the electrolysis cell, and the reaction product $CO_2$ is drawn off as a waste gas. Essentially, hydrogen gas is generated through the consumption of hydrocarbon fuel. As a result, the production cost of hydrogen gas using this process is relatively high. Furthermore, the use of hazardous CO gas will make the process of doubtful acceptance for utility applications.

Brecher et al., in U.S. Pat. No. 3,888,750, produce $H_2$ from water, utilizing aqueous sulfuric acid as the electrolyte in an electrolyzer. There, water and $SO_2$ are supplied to the electrolyzer to produce $H_2SO_3$. The $H_2SO_3$ is electrochemically oxidized to form $H_2SO_4$, while $H_2$ is produced at the cathode. The $H_2SO_4$ is drawn off, concentrated by evaporation, and then catalytically decomposed at about 870° C. in a reduction reactor. Primary products include $H_2O$, $SO_2$ and $O_2$. The $SO_2$ is liquified to separate it from the $O_2$, after which the $SO_2$ is vaporized and returned to the electrolyzer.

The cycle efficiency of the Brecher et al. system is about 45% at which the optimum concentration of $H_2SO_4$ in the electrolyzer is about 55 wt.%. Thus, a large amount of energy must be expended in concentrating the $H_2SO_4$ by evaporation prior to decomposition. The evaporation step is the major source of efficiency loss here. In addition, aggressive hydronium ions, $H_3O^+$, are present during the recovering processes of $SO_2$, causing possible corrosion problems for acid vaporizers and reduction reactors, and requiring the use of costly construction materials, such as silicon, silicon carbide, silicon nitride and silicide coated Incoloy (alloy of nickel, iron, and chromium). Also, special separators are needed in the electrolyzer design to prevent $SO_2$ migration from the anodic compartment to the cathode, where it can be reduced to sulfur or hydrogen sulfide.

What is needed is a highly efficient method of $H_2$ production from water or steam, utilizing a closed cycle, and eliminating $H_2SO_4$ treatment and use of CO gas as a feed.

SUMMARY OF THE INVENTION

The above needs have been met and the above problems solved by providing a method of producing $H_2$ from water vapor in a closed system, utilizing $SO_2$ as an anode depolarizer in a solid oxide electrolyte electrolysis cell which produces no $H_2SO_4$ solution.

More specifically, the method of this invention comprises decomposing water vapor (steam) into hydrogen and oxygen with an apparatus which includes: electrolysis means effective to roduce $H_2$, having positive and negative electrodes with a solid oxide electrolyte impervious to $H_2$ and $SO_2$ disposed therebetween; $SO_3$ separation means; $SO_3$ reduction reactor means and $O_2$ separation means. Steam is fed to the cathode of an electrolysis cell operating at between 350° C. and 1,000° C., and utilizing a solid oxide electrolyte having a high oxygen ion conduction, such as, preferably zirconia stabilized with about 8 mole % to 10 mole % yttria. Hydrogen gas exits the system and is collected. Meanwhile $SO_2$ is fed to the anode of the cell where it is electrochemically oxidized to form $SO_3$. Unconsumed $SO_2$ is separated from $SO_3$ in a gas separation means, and returned to the electrolysis cell. The $SO_3$ is passed into a reduction reactor where it is catalytically decomposed at between about 800° C. and about 900° C., to produce $SO_2$ and $O_2$, which are then passed to an $O_2$ recovery means. Oxygen gas exits the system and is collected, while $SO_2$ is returned to the anode of the electrolysis cell.

As a result, the overall reaction in the system is the decomposition of water vapor to produce $H_2$ and $O_2$, using a small quantity of electrical energy and a relatively large amount of thermal energy from, for example, a pressurized water nuclear reactor, or a high-temperature, gas-cooled nuclear reactor. No hydrocarbon fuels are used, sulfuric acid associated problems are eliminated, and cycle efficiency of the system may be brought up to over 50%.

BRIEF DESCRIPTION OF THE DRAWING

For a better understanding of the invention, reference may be made to the preferred embodiments, exemplary of the invention, shown in the accompanying drawings, in which.

DESCRIPTION OF THE PREFERRED EMBODIMENTS

Figure 1:
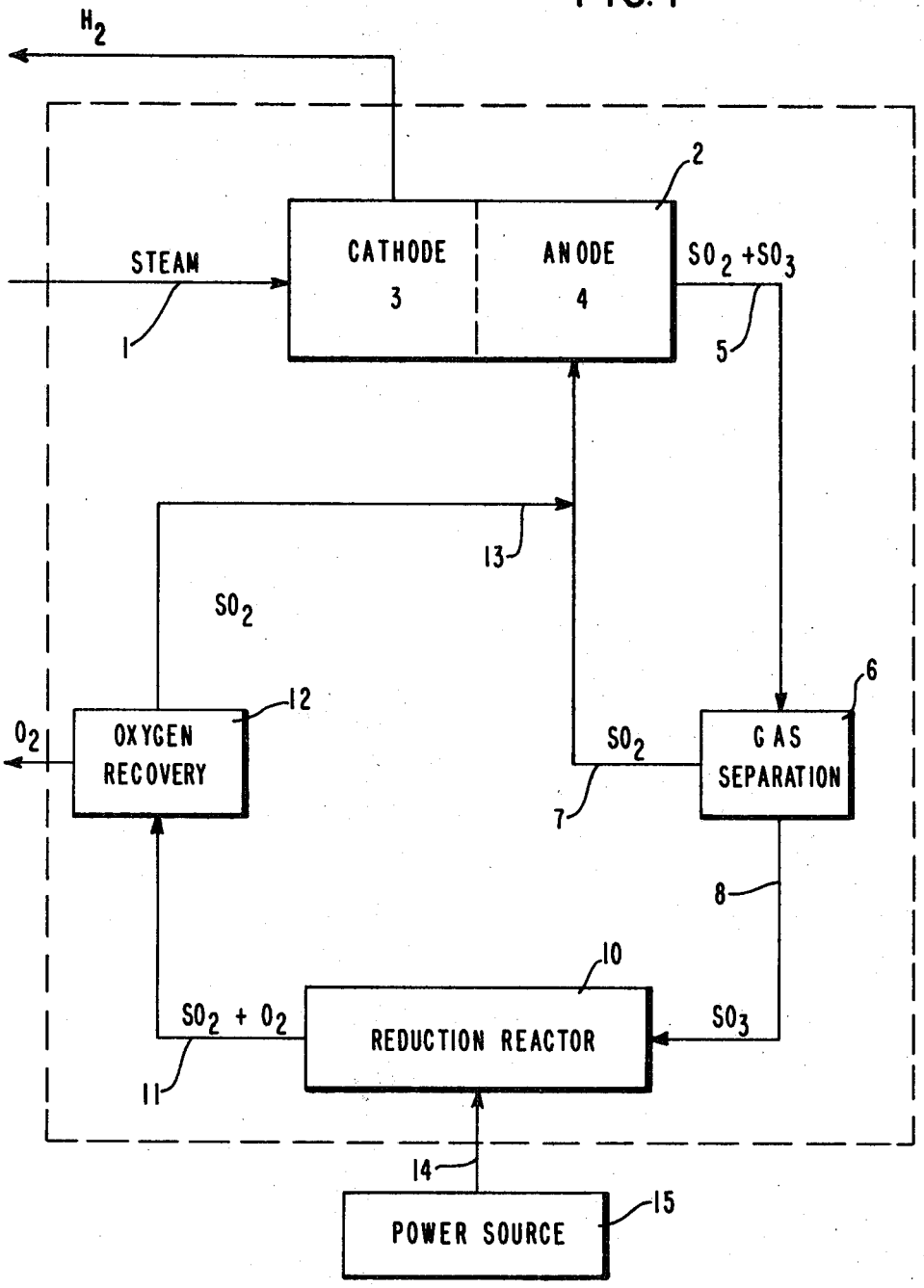
FIG. 1 is a flow chart of one embodiment of the closed system of this invention.

Referring now to FIG. 1 of the drawings, a feed stream 1 of water vapor (steam) is fed into solid oxide electrolyte electrolysis cell 2. The water vapor reacts with oxygen vacancies in the lattice of the solid oxide electrolyte, to produce hydrogen, which exits the system, and oxygen ions at the cathode 3. Through an oxygen-vacancy-migration mechanism, oxygen ions pass across the solid electrolyte and then electrochemically oxidize sulfur dioxide at the anode 4 to form sulfur trioxide, oxygen vacancies and electrons. The resulting sulfur trioxide along with unconsumed sulfur dioxide in stream 5 are separated in gas separation means 6, into sulfur dioxide stream 7, fed back into electrolysis cell 2, and sulfur trioxide stream 8. In the gas separation means, the gas temperature is lowered to a temperature effective to liquify the $SO_3$, allowing $SO_2$ gas separation.

The $SO_3$ in liquid form is vaporized and then catalytically decomposed at between about 800° C. and about 900° C. in a reduction reactor 10, producing sulfur dioxide gas and oxygen as in stream 11. The sulfur dioxide and oxygen are passed to oxygen recovery means 12, where oxygen exits the system. In the oxygen recovery means the gas temperature is lowered to a temperature effective to liquify the $SO_2$, allowing $O_2$ gas separation. The $SO_2$ liquid is then vaporized before passage into stream 13. Finally, the sulfur dioxide in stream 13 is recycled to the anode 4 of the electroylsis cell 2. Thermal energy 14 can be supplied from, for example, nuclear heat source 15. The closed system of the invention is shown inside the dashed lines of FIG. 1.

The chemical reactions involved in this cycle may be represented as follows:

Electrochemical: $H_2O+SO_2 \rightarrow H_2+SO_3$ 350° C.-1,000° C. [1]

Thermochemical: $SO_3 \rightarrow SO_2+\frac{1}{2}O_2$ 800° C.-900° C. [2]

Overall: $H_2O \Delta H_2+\frac{1}{2}O_2$ [3]

Water vapor is decomposed to generate hydrogen at the cathode of a solid oxide electrolyte electrolysis cell, operating at a temperature in the range of 350° C. to 1,000° C. preferably 600° C. to 900° C., while sulfur dioxide is electrochemically oxidized to form sulfur trioxide at the anode.

By operating at elevated temperatures, over 350° C., high current densities are achievable at relatively low cell voltages because of negligible polarization effects on the electrodes at such temperatures. Under 350° C., the solid oxide electrolyte exhibits high resistance to oxygen ion migration. Over 1,000° C., materials problems occur with no significant improvement in efficiency. The reaction in the electrolysis cell is exothermic and so does not require a great deal of energy input. The unconsumed sulfur dioxide is separated from the sulfur trioxide and then returned to the electrolyzer.

The resulting sulfur trioxide passes to a reduction reactor, where sulfur trioxide is heated at preferably 870° C. over a catalyst, for example, of platinum, iron oxide or vanadium pentoxide, to decompose it into sulfur dioxide and oxygen. This is a highly endothermic reaction requiring most of the energy put into the system. The resulting gas mixture is then passed to an oxygen recovery unit in which the sulfur dioxide is separated from the oxygen by lowering the temperature, to condense the sulfur dioxide into a liquid. The liquified sulfur dioxide is vaporized and returned to the anode of the electrolyzer, to complete the cycle.

Figure 2:
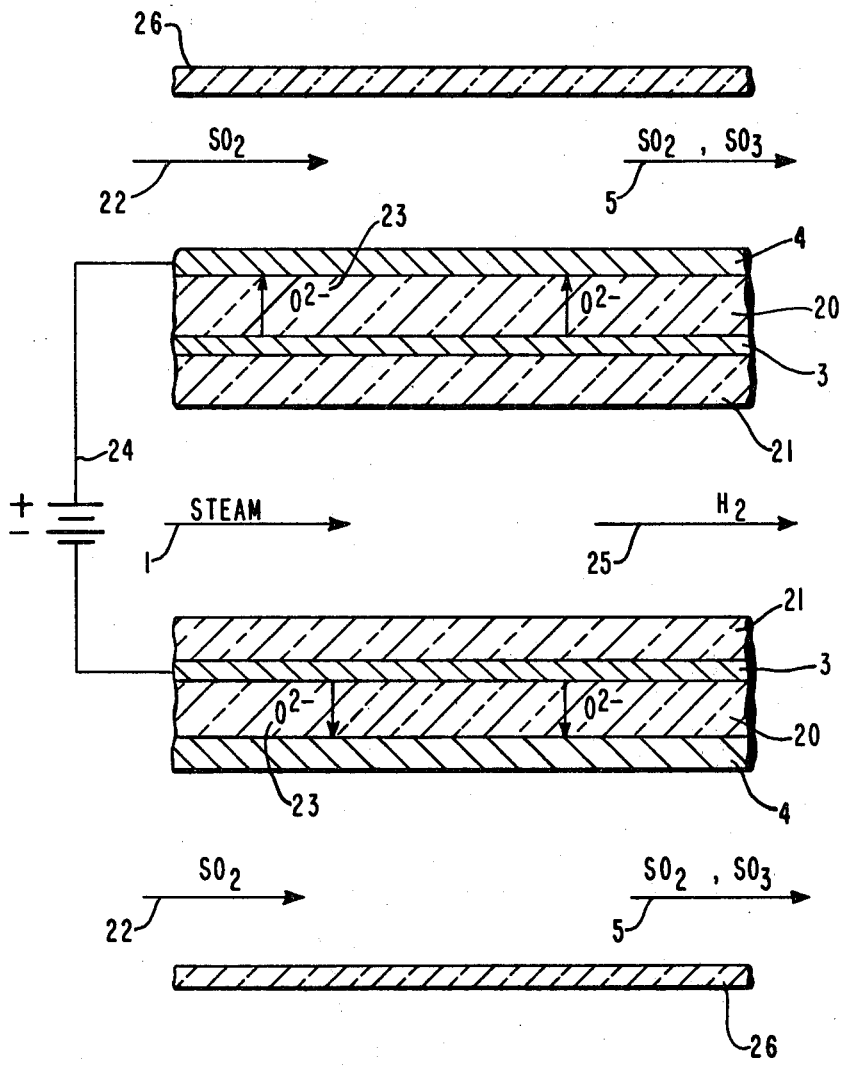
FIG. 2 is a schematic diagram of the cross section of the tubular solid oxide electrolyte electrolysis cell shown in FIG. 1.

This invention emphasizes the use of solid oxide electrolyte. The schematic cross-section of a tubular solid oxide electrolysis cell is shown in FIG. 2 of the drawings. The anode 4, electrolyte 20 and cathode 3 layers are deposited, in sequence, on a porous ceramic inner tube 21. With pore diameters of as large as 10 μm., the tube porosity allows water vapor 1 in the central cathode chamber to diffuse and reach the cathode 3 during the electrolysis. The solid oxide electrolyte should have a high oxygen ionic conductivity, a negligible electronic conductivity, high mechanical strength, good gas-tightness, high density, and no phase transformation at or below the operating temperature of the cell.

The candidate materials to meet these solid oxide electrolyte requirements include stabilized zirconia, stabilized ceria, stabilized thoria and stabilized bismuth oxide. The preferred electrolyte is stabilized zirconia, to which has been added calcium oxide, magnesium oxide, yttrium oxide, ytterbrium oxide or a mixture of rare earth oxides. The most preferred electrolyte is stabilized zirconia containing about 8 mole % to about 10 mole % yttria. Although the thickness of the electrolyte layer can vary from 10 μm. to 50 μm., the desired electrolyte thickness is about 20 μm. The solid oxide electrolyte is impervious to both $H_2$ to $SO_2$ and thus also functions as a separator within the cell.

The suitable materials for use as anode 4 include platinum, palladium, gold, silver, palladium oxide, doped indium oxide, doped lanthanum chromite, lanthanum-nickel mixed oxide and the alloys of these metals. The cathode 3 can be made from nickel, cobalt, or their alloys, with additions of zirconia. The preferential thicknesses of both anode and cathode layers are about 20 μm. The construction of these cells and the materials used in them are well known in the art.

During the electrolysis, the sulfur dioxide 22, passing between the outer tube 26 and the anode 4, in the anode chamber, is electrochemically combined with oxygen ions 23 to form sulfur trioxide, oxygen vacancy and electrons at the anode/electrolyte interface:

$$SO_2+O^{2-} \rightarrow SO_3+V_o+2e^- \quad [4]$$

where $O^{2-}$ and $V_o$ represent an oxygen ion and an oxygen vacancy in the lattice of solid oxide electrolyte. Unconsumed $SO_2$ and $SO_3$ exit via stream 5. The electrons pass via an external circuit 24 to the cathode/electrolyte interface, where water vapor reacts with oxygen vacancies to generate hydrogen and oxygen ions:

$$H_2O+V_o+2e^- \rightarrow H_2+O^{2-} \quad [5]$$

The hydrogen stream is shown as 25. The outer tube 26 is made of dense ceramic. Through the migration of oxygen vacancies, the oxygen ions produced at the cathode/electrolyte interface pass across the solid electrolyte and are completely consumed to form sulfur trioxide at the anode/electrolyte interface. Consequently, the net reaction in the electrolysis cell can be expressed by:

$$H_2O+SO_2 \rightarrow H_2+SO_3 \quad [1]$$

Initially, $SO_2$ must be supplied to the electrolysis cell until a steady state operation is achieved. Inexpensive metals or metal oxides can be used in the fabrication of the electrolysis cell components, so that capital expenditures will be substantially lower than that of electrolyzers utilizing aqueous $H_2SO_4$ electrolyte.

The heat energy 14 required for reaction (2), and possibly reaction (1) can be supplied, at least in part, by an in-place nuclear reactor. These endothermic demands can be met by relatively low-cost nuclear energy, derived, for example, from a very high-temperature, gas-cooled, nuclear reactor, or a liquid-cooled nuclear reactor, both well known in the art, and described in detail by Tobin, in U.S. Pat. No. 4,113,563, and by Obenmeyer et al., in U.S. Pat. No. 4,173,513.

I claim:

1. A method of decomposing water vapor into hydrogen and oxygen comprising the steps of:

(1) supplying $SO_2$ gas to the anode and water vapor to the cathode of an electrolysis cell utilizing a solid oxide electrolyte between the anode and cathode of the cell, said solid oxide electrolyte having a high oxygen ion conduction, said cell operating at a temperature of between 350° C. and 1,000° C., to provide $H_2$ gas, and a gas mixture consisting of $SO_2$ gas and $SO_3$ gas;

(2) collecting the $H_2$ gas;

(3) passing $SO_3$ into a reduction reactor operating at a temperature effective to catalytically decompose the $SO_3$ and provide a mixture of $SO_2$ gas and $O_2$ gas;

(4) collecting the $O_2$ gas from step (3); and (5) passing $SO_2$ gas to the anode of the solid oxide electrolyte electrolysis cell.

2. The method of claim 1, where the solid oxide electrolyte is impervious to $H_2$ gas and $SO_2$ gas, and where $SO_2$ gas is separated from $SO_3$ gas in a gas separation means before the $SO_3$ is passed into the reduction reactor in step (3).

3. The method of claim 1, where the reduction reactor operates at a temperature of between about 800° C. and about 900° C., to catalytically decompose the $SO_3$.

4. The method of claim 1, where, in step (4) the oxygen gas is separated from the $SO_2$ gas by condensing the $SO_2$ into a liquid, after which the liquid $SO_2$ is vaporized before being passed to the anode of the electrolysis cell in step (5).

5. The method of claim 1, where thermal energy for the reduction reactor is supplied, at least in part, by a nuclear reactor.

6. The method of claim 1, where the water vapor at the cathode of the cell reacts with oxygen vacancies in the lattice of the solid oxide electrolyte to produce hydrogen gas, and oxygen ions which pass across the solid electrolyte to electrochemically oxidize $SO_2$ gas at the anode of the cell.

7. The method of claim 1, where the solid oxide electrolyte is selected from the group consisting of stabilized zirconia, stabilized ceria, stabilized thoria and stabilized bismuth oxide.

8. The method of claim 1, where the solid oxide electrolyte is zirconia stabilized with yttria.

* * * * *